United States Patent [19]

Memminger et al.

[11] Patent Number: 4,687,151

[45] Date of Patent: Aug. 18, 1987

[54] TEXTILE YARN PULL-OFF SYSTEM

[75] Inventors: Gustav Memminger, Heideweg 65, D-7290 Freudenstadt; Erich Roser, Bermatingen, both of Fed. Rep. of Germany

[73] Assignee: Gustav Memminger, Freudenstadt, Fed. Rep. of Germany

[21] Appl. No.: 759,662

[22] Filed: Jul. 26, 1985

[30] Foreign Application Priority Data

Aug. 8, 1984 [DE] Fed. Rep. of Germany ..... 3429193

[51] Int. Cl.[4] ..... B65H 49/02; B65H 49/06; B65H 49/18

[52] U.S. Cl. ..... 242/54 R; 242/128

[58] Field of Search ..... 226/42, 24, 10, 145; 242/47.01, 45, 128, 54 R; 66/210, 211, 212, 132 R; 112/79 A

[56] References Cited

U.S. PATENT DOCUMENTS

| | | | |
|---|---|---|---|
| 787,717 | 4/1905 | Bates . | |
| 2,847,763 | 8/1958 | Thomas | 226/46 X |
| 3,648,939 | 3/1972 | Rosen | 66/132 X |
| 3,858,415 | 1/1975 | Wilson et al. | 66/210 |
| 3,962,891 | 6/1976 | Rouzavd | 66/132 R |
| 4,200,212 | 4/1980 | Hartig et al. | 226/42 X |
| 4,353,227 | 10/1982 | Shields et al. | 66/146 |

FOREIGN PATENT DOCUMENTS

| | | | |
|---|---|---|---|
| 1312803 | 4/1973 | United Kingdom | 66/210 |
| 1490293 | 10/1977 | United Kingdom . | |
| 2109022 | 5/1983 | United Kingdom . | |

*Primary Examiner*—Stanley N. Gilreath
*Assistant Examiner*—Lynn M. Sohacki
*Attorney, Agent, or Firm*—Frishauf, Holtz, Goodman & Woodward

[57] ABSTRACT

An apparatus intended particularly for pulling filamentary spooled material, such as yarn, from a spool has a spool holder, receiving the spool, and a flyer arm, preferably rotatably supported about the axis of the spool. The flyer arm carries yarn guide elements for the spooled yarn arriving from the spool and traveling to a yarn user. In order to assure gentle, regulated pulling off of the spooled material, the arrangement is such that the flyer arm and/or the rotatably supported spool holder is coupled with a speed controlled electric drive motor, and the flyer arm has sensing means which scan the spooled yarn arriving from the spool and emit an output signal representative of the spooled yarn travel speed with respect to the flyer arm. The speed of the drive motor is synchronized with the output signal of the sensing means.

21 Claims, 6 Drawing Figures

TEXTILE YARN PULL-OFF SYSTEM

Reference to related application, by the inventors hereof, assigned to the assignee of the present application, U.S. Ser. No. 759,653, filed July 26, 1985, MEMMINGER S ROSE now U.S. Pat. No. 4,673,139.

The present invention relates to spooling systems for textile machinery and more particularly to a yarn pull-off system in which filamentary material is removed from a spool or the like for supply to the textile machine which, for example, may be a weaving loom, or more particularly a knitting machine, and especially a circular knitting machine.

In the specification and the claims that follow, the term "yarn" will be used generically for any filamentary material to be supplied: likewise, the term "spool" will be used generically for any device holding the yarn in the form of a spool or the like, that is, for example, a yarn pirn, a yarn package, from which yarn can be removed and supplied to a utilization point, for example, a knitting feed of a circular knitting machine. For simplicity

THE INVENTION

It is an object to provide an apparatus, in particular for pulling filamentary spooled material such as yarn from a spool, which enables furnishing of the spooled material in accordance with usage, in whatever quantity is needed per unit of time, while handling the spooled yarn as gently as possible and maintaining constant tension on the yarn.

Briefly, a flyer arm element and/or a spool holder element are rotatably supported; the one, or both of these elements which are rotatably supported, is, or are, coupled with a speed controlled electric drive motor. The flyer arm has yarn pull-off speed sensing means, or feelers, that scan the spooled yarn arriving from the spool and emit an output signal representative of the travel or pull-off speed of the spooled yarn with respect to the flyer arm. The speed of the drive motor is controlled by the output signal of the sensing means.

A control loop is thus formed in which the yarn itself forms part of the loop: the feeler arm element and/or the spool element, whichever, or both, are rotatable; the yarn itself; the yarn pull-off speed sensing means; the output signal from the yarn pull-off speed sensing means which controls the speed of the drive motor; the drive motor coupled to and driving the respective rotatable element or elements. No external "desired" or "command" yarn speed/actual speed comparator or control by the utilization machine, for example a circular knitting machine, is used.

Once the pulling off of spooled yarn has begun for instance beginning from a standstill, then a spooled yarn pull-off speed appears at the sensing means, which leads directly to a corresponding output signal of the sensing means; this signal, in turn, causes the drive motor or motors to generate a corresponding relative speed between the flyer arm and the spool. The greater the pull-off speed of the spooled yarn, that is, the greater the amount of spooled yarn removed by the user, the higher will be the travel speed of the spooled yarn. Since the sensing means measuring this travel speed are electrically coupled to control, e.g., synchronize, the drive motor, spooled yarn is always furnished in the required quantity per unit of time. The spooled yarn is positively unwound from the spool, of explanation, thus, the terms "yarn" and "spool" will be used hereinafter although, of course, they are deemed to include the equivalent and similar structures which, in the textile art, may have acquired specialized terms. Such specialized terms are omitted for clarity and brevity of the specification.

BACKGROUND

An apparatus of this kind is known, for instance from U.S. Pat. No. 787,717. A double arm flyer which carries yarn guide elements in the form of yarn eyes is freely rotatable on a cylindrical tang, which is coaxial with the spool, and is provided with a brake in the form of a helical spring, which offers a predetermined adjustable resistance to the rotation of the flyer arm. Since neither the spool nor the flyer arm is driven, a certain tensile force must be applied to the spooled yarn in order to unwind it; this tensile force depends on the braking torque exerted by the brake, among other factors. With delicate spooled yarn or highly elastic spooled yarn, for instance, it is no longer readily possible to generate the relative movement between the flyer arm and the spool by means of a tensile force generated in the spooled yarn. The unvending process becomes uneven, especially if the spooled yarn must be pulled off the spool at a variable travel speed. Further, the parts set to rotating by the pulled-off spooled yarn have considerable inertia, which means that when the travel speed of the pulled-off spooled yarn changes, the tension on the yarn fluctuates, and this is inappropriate or impermissible in many applications. regardless of the tension that is maintained in the spooled yarn, thereby protecting against unevenness in the tension of the unwinding spooled yarn. At the same time, the spooled yarn itself is handled gently, because it need not absorb any tensile stresses needed for the unwinding. The spooled yarn can be pulled off at any arbitrary adjustable tension; yarn pull-off is even readily possible with a zero tension.

If the amount of spooled yarn removed varies greatly over time, elongations can occur briefly in the spooled yarn, in the area between the sensing means and the spool; often, these elongations can be absorbed by the inherent elasticity of the spooled yarn. If a special yarn does not allow this, it is useful to provide a yarn reserve on the yarn path between the spool and the sensing means. In this case it is advantageous if the apparatus has a regulator which maintains the size of the yarn reserve at a command value. (See referenced application Ser. No. 759,653, filed July 26, 1985, Memminger and Roser, now U.S. Pat. No. 4,673,139).

In a preferred embodiment, the arrangement is also such that the apparatus has adjustable tensioning means controlling the tension of the spooled yarn unwinding from the spool. These tensioning means are located along the spooled yarn path between the spool and the sensing means. If necessary, a spooled yarn tension regulator then maintains the tension on the spooled yarn automatically at a predetermined command value can be coupled with these tensioning means.

The drive motor is advantageously a stepping motor, which is supplied with the output signal of the sensing means, which if necessary is converted into a corresponding stepping pulse train and amplified. Alternatvely, in particular with spooled material that is difficult to handle, such as cables or wire, the apparatus may also be so formed that it has a servo regulator that continuously readjusts the speed of the drive motor, which in particular is formed as a stepping-motor, to the output signal of the sensing means, which acts as a command value.

Very simple structural conditions are attained if the sensing means are formed by a low inertia measuring wheel coupled in a slip free manner with the spooled yarn and combined with a signal transducer. This signal transducer may be in the form of a tachometer generator, which emits an analog voltage, an angle code reader, or the like.

The tensioning means suitably have a movable tensioning element acting on the spooled yarn between the spool and the sensing means, transversely to the yarn travel direction, and loaded with an adjustable force. This force may be provided by a weight, a spring force, an electromotor force and/or a centrifugal component.

Since the sensing means already furnish an output signal representative of the spooled yarn travel speed, this output signal can simultaneously also be used to supply a display device for displaying the quantity of unwound spooled yarn per unit of time. The display device may at the same time include a display for the tension of the furnished yarn, as measured by a spooled yarn tension measuring device.

If the spooled yarn should have lost its tension, for instance because of yarn breakage and subsequent retying of the yarn, or for other reasons, or if the yarn is sagging in the vicinity of the flyer arm, then before the unwinding operation can be resumed it must first be made taut. This can be done in a simple manner by coupling a rotation reversal switch with the drive motor. By the simple actuation of this rotation reversal switch, the spooled yarn is wound onto the spool until the conditions necessary for resuming the unwinding operation are reestablished.

The arrangement can also be such that a tension monitor is coupled with the drive motor, and if the spooled yarn tension drops below a predetermined threshold and there is an interruption in the unwinding of spooled yarn, this tension monitor emits a signal that reverses the drive motor, causing the drive motor to generate a relative rotation between the flyer arm and the spool in the direction of yarn rewinding, until the predetermined spooled yarn tension value has been attained.

The term "spooled yarn" is intended to encompass all kinds of material that can be wound up, such as yarns, filaments, and fiber strips, but also wire and the like. The sensing means for the spooled yarn travel speed may, instead of the measuring wheel mentioned above, be of some other kind as well, including means capable of scanning the spooled yarn without touching it.

The apparatus is particularly intended for pulling spooled yarn from a spool. However, it may equally well be used for winding spooled yarn onto a spool, in which case it is assured that the spooled yarn is always wound up at a predetermined tension.

Naturally a traversing movement back and forth in the axial direction between the spool and the flyer arm can also be provided during the winding or unwinding operation. The mechanisms required to effect this movement are known and are accordingly not described in detail here.

DRAWINGS

DETAILED DESCRIPTION

Figure 1:
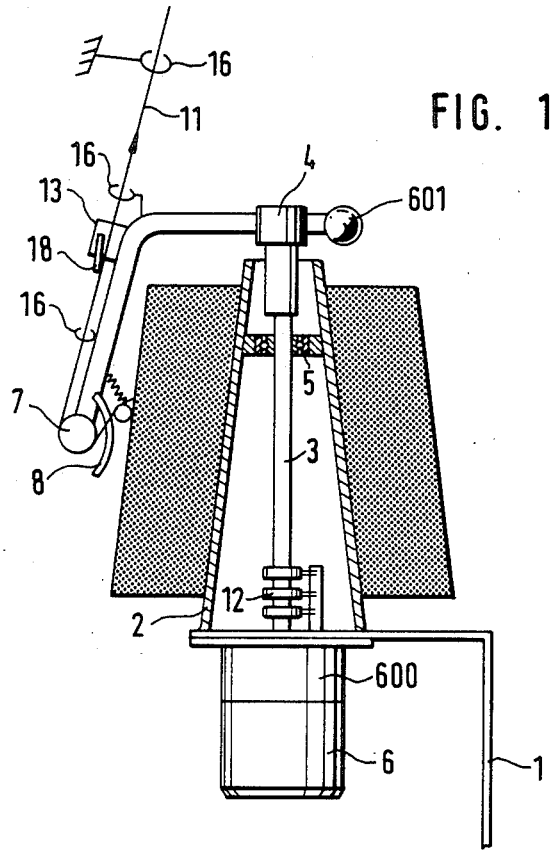
FIG. 1 is a schematic side view, in axial section of an apparatus according to the invention.
Figure 2:
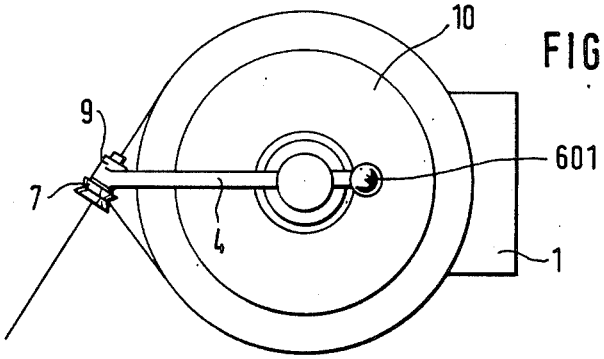
FIG. 2 shows the apparatus of FIG. 1 in plan view.
Figure 4:
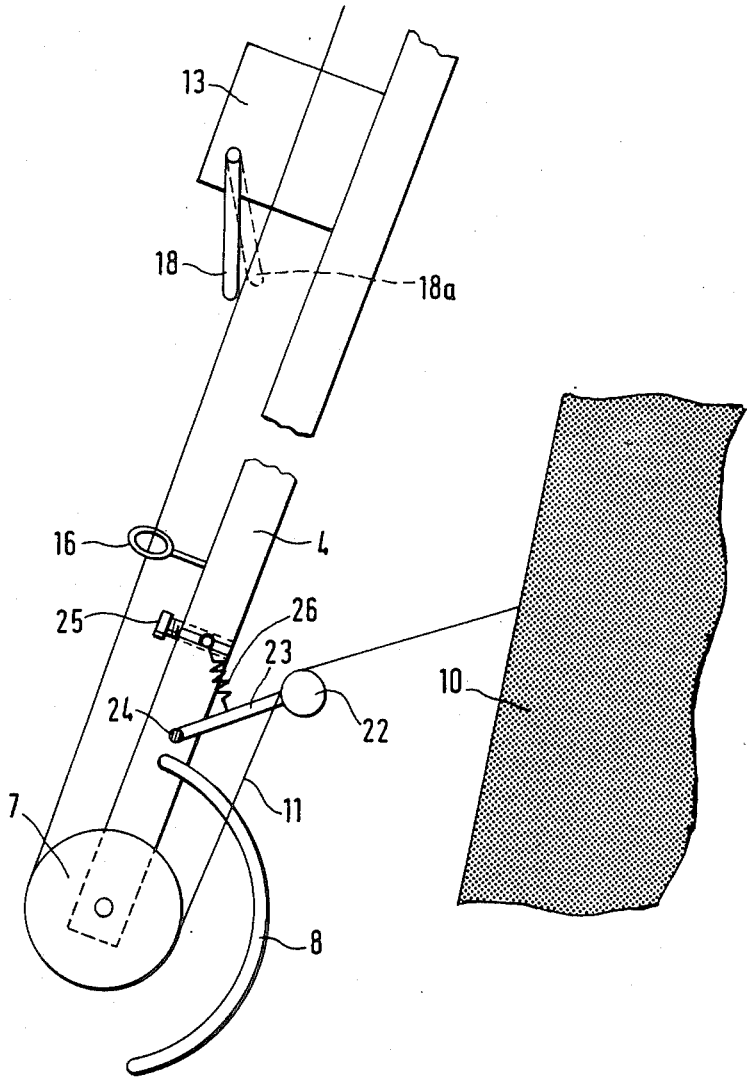
FIG. 4 is a detail of the flyer arm of the apparatus of FIG. 1, shown in a side view and on a different scale.

The apparatus shown in FIGS. 1, 4 has a spool holder 1, on which a conical mounting tube 2 is placed, through which a coaxial drive shaft 3 extends, which is joined in a rotationally fixed manner with a hollow, substantially L-shaped flyer arm 4. Yarn 11 is removed essentially tangentially from the spool 10 (FIG. 2). The drive shaft 3 is rotatably supported at 5 and is joined in a rotationally fixed manner with a stepping motor 6, secured to the spool holder 1, via a gear 600. The flyer arm is balanced at its end with a counterweight 601.

A small low inertia measuring wheel 7 (FIGS. 1 and 3) is rotatably supported on the end of the flyer arm 4, forming a sensing means for the supply speed of the pulled-off yarn, and is coupled via a shaft with a tachometer generator 9 that is also located on the flyer arm 4. Instead of the tachometer generator 9, an angle code reader or some other pulse transducer can also be used.

The yarn 11 arriving from a spool 10 mounted on the mounting tube 2 in a rotationally fixed manner travels to the circumferential surface of the measuring wheel 7, which is spaced apart from the spool 10, viewed in the direction of yarn travel. The yarn is looped in several adjacent windings around the cylindrical circumferential surface of the measuring wheel 7, the number of loops being such that the measuring wheel 7 is coupled with the yarn 11 in a slip free manner.

The yarn 11 that leaves the measuring wheel 7 is guided by three run-out eyes 16, one of which is stationary and preferably located coaxially with the drive shaft 3. Between the two run-out eyes 16, the yarn 11 that is running out is scanned by the feeler arm 18 of a run-out shutoff device 13 attached to the flyer arm 4. The yarn emerging from the third run-out eye 16 is delivered to a yarn consumer, not otherwise shown.

In the area between the spool 10 and the measuring wheel 7, the yarn 11 travels via a yarn tensioning roller 22 (FIG. 4) which is mounted on a lever arm 23 which is pivotably supported on the flyer arm 4 at 24 and is loaded with a tension spring 26, which is supported at one end on the flyer arm 4. The initial tension of the tension spring 26 at any given time is selectively adjustable by a screw 25.

As shown in FIG. 4, in the normal operating situation the yarn tensioning roller 22 is mounted in such a way that on its way from the circumferential surface of the spool 10 to the circumferential surface of the measuring wheel 7, the yarn 11 undergoes a deflection from the straight connecting line. By means of this deflection, a yarn reserve is formed, which in accordance with FIG. 4 can be used up by pivoting the lever arm 23 clockwise about the pivot axis 24. A guide bracket 8 secured to the flyer arm 4 assured reliable yarn guidance in the vicinity of the measuring wheel 7 of the tensioning roller 22.

Figure 3:
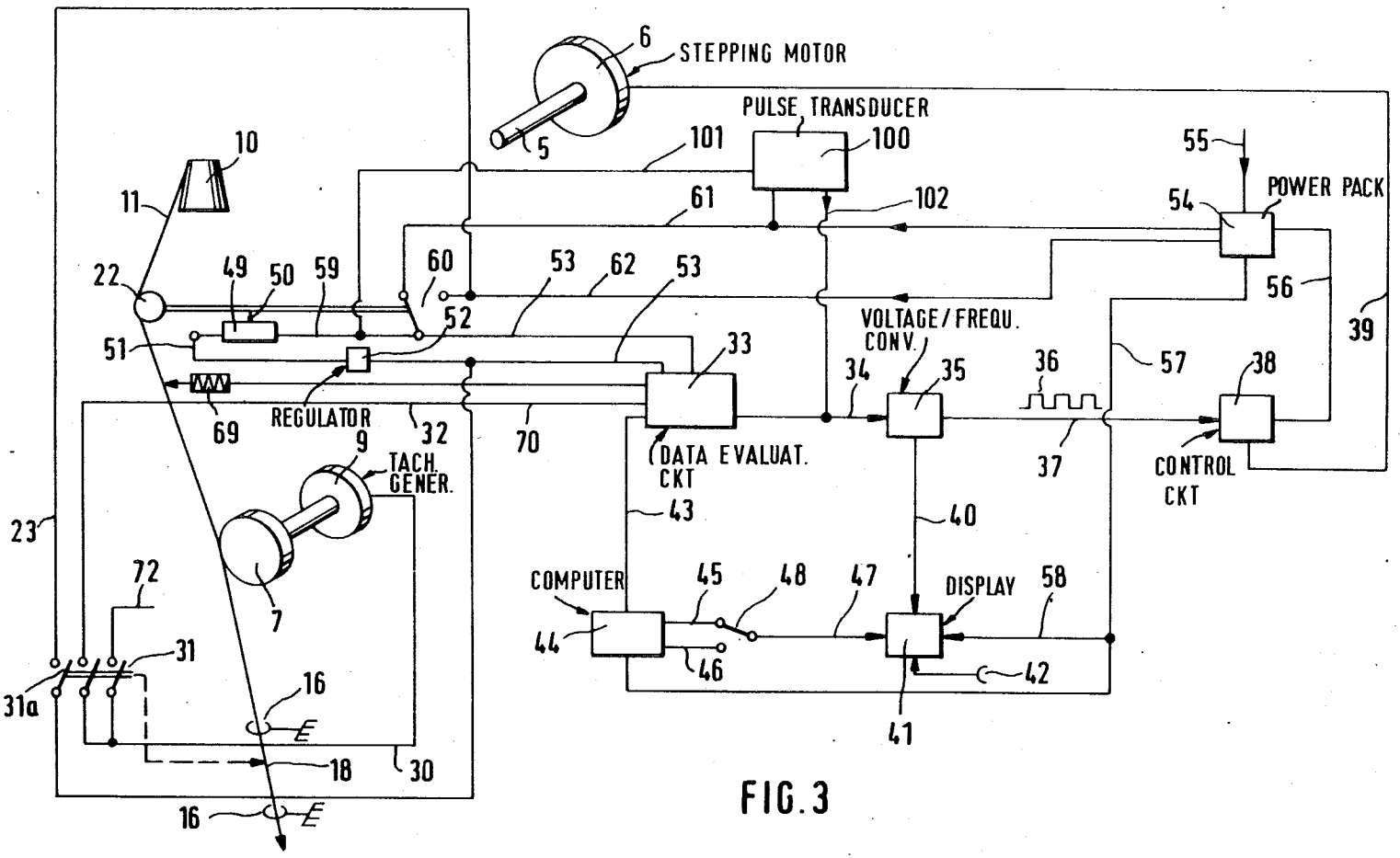
FIG. 3 is a block circuit diagram for the apparatus of FIG. 1.

As shown in FIG. 3, the tachometer generator 9 coupled with the measuring wheel 7 is equipped, via a line 30, a switch 31 the function of which will be explained below, and a line 32, with a data evaluation and distribution circuit 33, to which an output signal in the form of an analog voltage is supplied by the tachometer generator 9. This output signal is representative of the yarn travel speed. For electrical connection between the tachometer generator 9 and other electrical device disposed on the flyer arm 4, as well as the electronic circuit shown in FIG. 3 and located in a fixed location on the spool holder 1, slip rings 12 provided on the drive shaft 5 are used.

Connected to the output side of the data evaluation and distribution circuit 33, via a line 34, is a voltage/frequency converter 35, which converts the analog output signal of the tachometer generator 9, which may have been amplified in the data evaluation and distribution circuit 33, into a pulse train the pulse frequency of which is representative of the yarn travel speed. This pulse output signal 36 is supplied via a line 37 to a control circuit 38, which on the output side is connected via a line 39 to the stepping motor 6.

Connected to the voltage/frequency converter 35 via a line 40 is a display device in the form of a display 41, to which the pulse output signal 36 of the tachometer generator 9, which represents the yarn travel speed, is accordingly delivered, and which digitally displays the value of the yarn travel speed at any given time. This display can be provided on one side of the spool holder 1.

Via the line 40, a coupling device, in the form of a plug device 42, for external signal lines is supplied by the the voltage/frequency converter 35 with the pulse output signal of the tachometer generator 9; it is thereby possible to evaluate this signal outside the yarn supply apparatus as well, which will be explained in detail further below.

A computer 44 is connected via a line 43 with the data evaluation and distribution circuit 33 or optionally with the voltage/frequency converter 35; the computer 44 makes it possible to store and/or monitor data supplied via the line 43 and to emit an output signal that is representative of the given data, or of the results of monitoring, to a line 47 leading to the display 41, so that the corresponding data can be displayed there. A selector switch 48 located between the lines 45, 46 and 47 enables various outputs of the computer 44 to be triggered selectively.

The wiper 50 of a potentiometer, schematically shown at 49 in FIG. 3, is connected to the pivot axis 24 of the lever arm 23. This potentiometer emits a signal representing the angular position of the lever arm 23, and thus representing the location of the tensioning roller 22, via a line 51, which is connected to a regulator 52, which contains a command value transducer and is connected via a line 53 to the control circuit 38.

Electric current is supplied to the individual portions of the circuit by means of a power pack 54, the power supply line of which is shown at 55 and the current supply lines of which, leading to the individual parts of the circuit, are identified as 56–58.

The supply of electric current to the data evaluation and distribution circuit 33 is effected via a line 59 and a switch 60, which is mechanically coupled to the tensioning roller 22. Two supply lines 61, 62 carrying supply voltages of opposite polarity are connected to the switch 60, so that from the polarity of the supply voltage present on the line 59, the data evaluation and distribution circuit 33 can recognize the position of the switch 60.

OPERATION

Initially, it is assumed that the yarn demand of the yarn user is zero. The yarn supply apparatus assumes the position shown in FIG. 1. The yarn is under tension; the magnitude of the yarn tension is determined by the adjustment of the tensioning 26.

When the yarn user begins to remove yarn, yarn is removed via the run-out eyes 16. Thus the measuring wheel 7 is set into clockwise rotation, as shown in FIG. 1, and the yarn reserve formed by the yarn tensioning roller 22 is reduced or partially consumed.

Once the measuring wheel 7 begins to turn, the tachometer generator 9 emits an output signal, via the line 30, that is proportional to the yarn travel speed; this signal is delivered by the data evaluation and distribution circuit 33 to the voltage/frequency converter 35. There the analog output signal is converted into a stepping pulse signal having a corresponding stepping frequency, which is also proportional to the yarn travel speed. This pulse output signal 36 is then delivered, via the control circuit 38 and the line 39, to the stepping motor 6, which drives the flyer arm 4 at a speed corresponding to the yarn travel speed. Each of the pulses proceeding from the control circuit 38 to the stepping motor 6 can correspond to either one full angular increment, or merely a portion of the angular increment, of the stepping motor 6.

At the same time, via the line 43, the computer 44 receives the data pertaining to the yarn travel speed, which is either stored in the computer or used to generate an output signal, which via the lines 45, 47 and the switch 48, which is in the position shown in FIG. 3, reaches the display 41, where it is displayed.

Regardless of how the yarn removal by the yarn user takes place chronologically, the stepping motor 6 thus drives the flyer arm 4 at a speed associated with the quantity of yarn being supplied at that time, the magnitude of this speed being determined by the measuring wheel 7. In this manner, via the tachometer generator 9 and the stepping motor 6 as well as the circuit portions 33, 35, 38 located between them, the measuring wheel 7 is rigidly synchronized electrically with the stepping motor 6.

It can thus be seen that the control loop is formed by: the measuring wheel 7 and the tachometer generator 9 coupled thereto; line 30 and circuits 33, 35, 38 and line 39; motor 6 and shaft 3, to which the flyer arm 4 is coupled; alternatively, the flyer arm may be stationary and the spool can be coupled to the motor; the yarn 11 itself, which is coupled in slip-free manner to the measuring wheel 7. The yarn closes the control loop. No external command operating speed/actual yarn operating speed comparator and associated controller is used in this loop.

The magnitude of the tension at which the yarn is delivered to the user is determined by the adjustment of the spring 26. Once yarn consumption stops, the speed of the measuring wheel 7 drops accordingly, and hence the speed of the stepping motor 6 and thus of the flyer arm 4 is reduced as well, until finally the apparatus has come to a stop. Even when the machine is at a stop, the yarn remains tensed at the predetermined value by means of the spring-loaded yarn tensioning roller 22 that acts on the yarn between the spool 10 and the measuring wheel 7.

The size of the yarn reserve formed by the yarn tensioning roller 22 varies when the yarn supply speed varies. It can be kept constant via the potentiometer 49 and the regulator 52. The potentiometer 49 emits a signal via the line 51 which is representative of the position at any given time of the position of the tensioning roller 22 and thus of the size of the yarn reserve present between spool 10 and the point where the yarn arrives at the measuring wheel 7. In the regulator 52, this signal is compared electrically with a command value. The result is a signal, corresponding with the deviation, if any, traveling via the line 53 to the control signal 38, which by correspondingly varying its output variable, which is emitted via the line 39, causes the stepping motor 6 to rotate about an angular value such as to compensate for the deviation. Since the regulation is integral, the deviation disappears.

The magnitude of the yarn tension that is established can be monitored by a separate tension feeler 69, which via the line 70 emits a corresponding measurement signal to the data evaluation and distribution circuit 33, which is turn passes a corresponding datum on to the computer 44. A datum representing the yarn tension can be interrogated at the output line 46 via the switch 48 and then displayed on the display device 41.

If when the machine shuts off the yarn tension of the yarn supply apparatus becomes zero ("O"), for instance because a sagging loop of yarn forms, or if it drops below a predetermined lower threshold, then the yarn tensioning roller 22 is pivoted by the spring 26 into a threshold position, in which the switch 60 coupled with the lever 23 is actuated via this lever. This reversal has the result that via a control line 101, a pulse transducer 100 that emits pulses of constant pulse frequency via a line 102 is switched on, and that the data evaluation and distribution circuit 33, via the voltage/frequency converter 35, furnishes a reversal command for the stepping motor 6 to the control circuit 38. Supplied with the pulses of the pulse transducer 100, the stepping motor 6 is started up in the rotational direction opposite the direction of yarn supply. Thus the flyer arm 4 begins to rewind the hanging loop of yarn, and continues this until such time as the yarn, as it becomes tenser, again returns the yarn tensioning roller 22 far enough toward its normal position that the switch 60 switches back into its normal position and the pulse transducer is switched off, as soon as the yarn is again in its normal position.

Instead of the spring 26, the yarn tensioning roller 22 can naturally also be loaded with an adjustable weight, an electromagnetic force, or a force generated in some other way. It is also possible for the tension feeler 69 to be combined directly with the yarn tensioning roller 22, that is, to use the yarn tensioning roller 22 itself, or the device generating the force coupled with it, for measuring the yarn tension.

In the described embodiment, the output signal of the tachometer generator 9—after appropriate signal conversion and amplification—controls the stepping motor 6 directly. Alternatively, the synchronizing between the stepping motor 6 and the tachometer generator 9 can also be done in such a manner that the output signal of the tachometer generator 9 is used as a command value, to which a servo regulator included in the control circuit constantly regulates the speed of the stepping motor 6.

The yarn run-out monitor, which with its feeler arm 19 scans the yarn 11 that is running out, actuates the switch 31 via its feeler arm 18 such that if the yarn breaks, on the one hand the output signal line of the tachometer generator 9 is interrupted, thus instantly stopping the stepping motor 6, and on the other hand a stop signal is sent to the yarn user via a line 72. This stoppage of the yarn supply is effected whenever the run-out feeler bracket 18 assumes the position shown in broken lines at **18*a* in FIG. 4**.

The coupling device 42, finally, makes it possible to supply signals representing the yarn tension and/or the yarn travel speed to a central, external display device or to a central regulating device, which affect the unwinding operation, if necessary, by controlling the electronic control circuits 38. The control commands can likewise be delivered to the voltage/frequency converter 35, and thence to the electronic control circuit 38, via the coupling device 42.

As shown in FIGS. 1, 2, the entire apparatus is in the form of a compact unit.

A manually actuated switch **31*a* makes it possible to selectively reverse the direction of rotation of the drive motor 6 briefly, via a line 73**.

Figure 5:
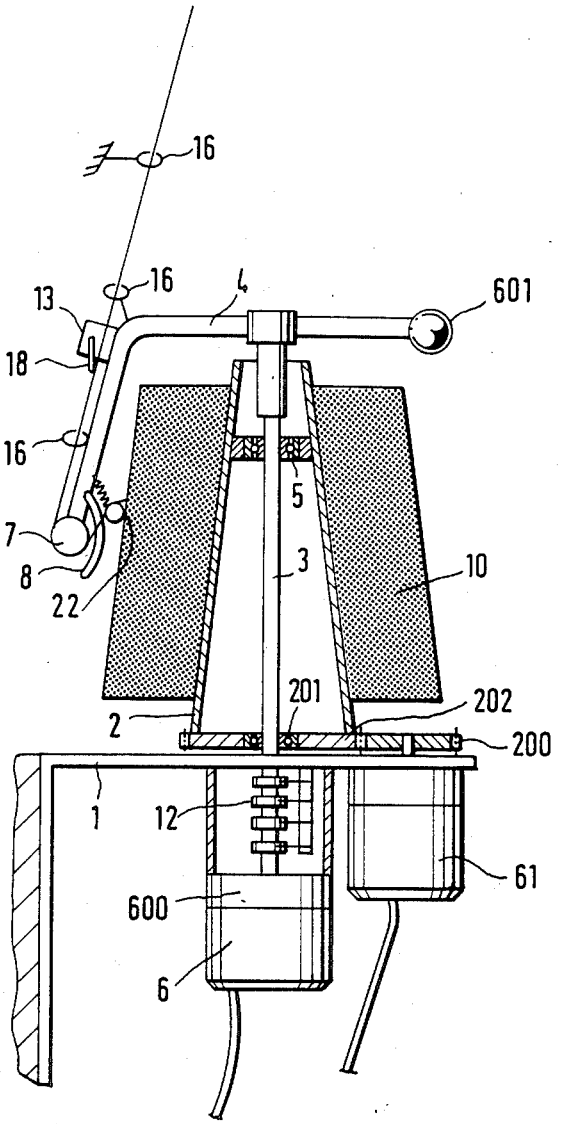
FIG. 5 is a schematic side view, in axial section, of a modified embodiment of an apparatus according to the invention.
Figure 6:
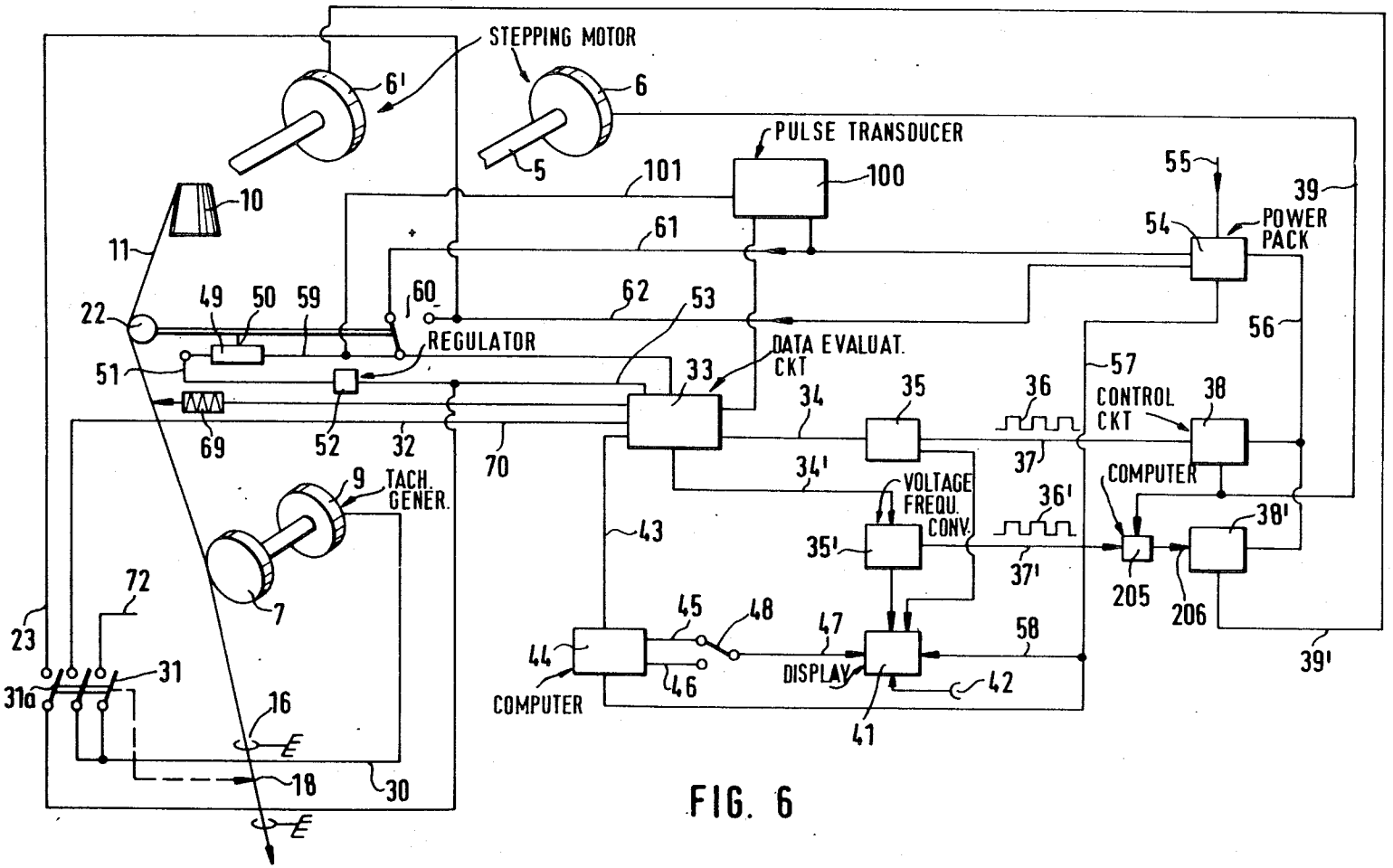
FIG. 6 is a block circuit diagram for the apparatus of FIG. 5.

In FIGS. 5, 6 a modified embodiment of the apparatus is shown, which corresponds in its essential parts and its essential function to that shown in FIGS. 1–4. Identical elements are therefore identified by identical reference numerals, and so the mode of operation need not be described again.

In addition to the embodiment of FIGS. 1–4, in the embodiment of FIGS. 5, 6 a second stepping motor 6' is mounted on the spool holder 1. Via a gear wheel 200, this stepping motor 6' drives a gear wheel 201, which is rotabably supported by means of a bearing 201 on the drive shaft 3 and is coaxial thereto; the mounting tube 2 is coaxially secured on the gear wheel 202.

The second drive motor formed as the stepping motor 6' makes it possible to rotate the spool 10 in the opposite direction from the flyer arm 4. As the spool diameter decreases, in other words, the speed of the flyer arm 4 must become correspondingly greater in the embodiment of FIGS. 1–4, if the yarn pull-off speed is to be kept constant. This may be undesirable, for mechanical reasons or with a view to the centrifugal and inertial forces that arise, if the speed of the flyer arm 4 drops below a predetermined threshold.

By appropriately driving the spool 10, the speed of the flyer arm 4 can be kept constant, or be kept below a predetermined threshold, for instance at a constant yarn pull-off speed.

In principle, the second stepping motor 6' is capable of driving the spool 10 at a constant speed; however, it is preferable for the drive by the stepping motor 6' to be effected such that when the spool 10 is full, the spool is driven slowly, and as the spool diameter decreases the spool drive speed increases, as a predetermined ratio to the speed of the flyer arm 4.

It is also possible for the spool 10 not to be driven along with the flyer arm until beyond a predetermined spool diameter; the flyer arm 4 revolves alone, until this spool diameter is attained.

The circuitry provided for controlling the second stepping motor 6' is shown in FIG. 6:

The data evaluation and distribution circuit 33 emits a corresponding output signal, via a line 34', to a second voltage/frequency converter 35', which in turn emits a pulse output signal 36' via a line 37'. This pulse output signal 36' is delivered to a programmable computer 205, which is also connected at one input to the stepping pulse line 39 of the first stepping motor 6 and which from this line receives stepping pulse signals representing the speed of the first stepping motor 6 and thus of the flyer arm 4. From the data delivered to it, the computer 205 calculates the pulse count required for the speed of the second stepping motor 6' corresponding to the spool diameter at a particular time, and via a line 206 delivers a corresponding output signal to a second control circuit 38', which via a line 39' in turn delivers the stepping pulses to the second stepping motor 6'.

Instead of and/or in addition to the signal representing the speed of the first stepping motor 6, a signal representing the yarn quantity pulled off the spool 10 could also be delivered to the computer 205; from this signal, the computer can then calculate the diameter of the spool 10 at that time automatically. Alternatively, it would also be possible to scan the spool diameter and to supply the computer directly with a signal of this kind, representing the spool diameter.

Thus the computer 205 is capable of controlling the second stepping motor 6', via the control circuit 38', as a function of the spool diameter. If need be, this may be done in addition to a speed-dependent control, for instance such that until a predetermined spool diameter is attained or possed, the variation in the speed of the second stepping motor 6' is effected as a function of the speed ratio with the flyer arm 4 and then as a function of the spool diameter.

In a simple embodiment, the arrangement may be such that the spool drive speed is at a fixed ratio to the flyer drive speed.

We claim:

1. Textile yarn removal and pull-off system to remove and pull off yarn (11) from a spool (10) and supply the yarn to a knitting feed of a knitting machine, as required by the knitting feed, having a stationary support means (1);

a spool support element (2) supported on the support means;

a flyer arm element (4) located to remove yarn tangentially from the spool, at least one of said elements (2, 4) being rotatable with respect to said support means (1);

a yarn guide means (16) secured to the flyer arm element to guide yarm removed from the spool and direct yarn to the knitting feed, a speed controllable electric drive motor (6, 6') drivingly coupled to the at least one of said elements (2, 4) which is rotatable;

a yarn pull-off speed sensing means (7, 9), secured to the flyer arm element having the yarn coupled thereto in slip-free manner and providing a yarn speed signal representative of the speed of yarn (11) being removed from the spool by said knitting feed at a speed determined by said knitting feed;

a control circuit means (33–38); and coupling means (30, 31) connected to said yarn pull-off speed sensing means for coupling the yarn speed signal to the control circuit means, said control circuit means (33–38) being coupled to the coupling means (30, 31) and receiving the yarn speed signal, said control circuit means being further connected to said motor, and controlling the speed of operation of said motor (6, 6') for controlling the output speed of the motor as a function of the speed of yarn sensed by the speed sensing means (7, 9) to control the motor speed as a function of the yarn speed signal, and wherein the yarn (11), the yarn pull-off—speed sensing means (7, 9), the drive motor (6) and the at least one rotatable element (2, 4) coupled to the motor form a closed control loop.

2. Yarn pull-off system according to claim 1, wherein a spooled yarn reserve is located on the spooled yarn travel path between the spool (10) (4) and the sensing means (7, 9).

3. Yarn pull-off system according to claim 2, including a regulator (52) maintaining the size of the spooled yarn reserve at a command value.

4. Yarn pull-off system according to claim 2, including adjustable tensioning means (22, 26) to subject the tensions on the yarn (11) unwinding from the spool (10) to a commanded tension value, said tension means being located in the yarn travel path between the spool (10) and the sensing means (7, 9).

5. Yarn pull-off system according to claim 4, including a yarn tension regulator (25) associated with the tensioning means (24, 26) and controlling said tensioning means for automatically maintaining the yarn tension at a predetermined command value.

6. Yarn pull-off system according to claim 1, wherein the drive motor (6) is a stepping motor, which is supplied with and controlled by the output signal of the sensing means (7, 9).

7. Yarn pull-off system according to claim 1, including a servo regulator continuously readjusting the speed of the drive motor (6) in accordance with the output signal of the sensing means (7, 9) which acts as a command value.

8. Yarn pull-off system according to claim 1, wherein the sensing means are formed as a low inertia measuring wheel (7) which is coupled with the spooled yarn (11);

and a signal transducer (9) is provided coupled to the measuring wheel (7).

9. Yarn pull-off system according to claim 4, wherein the tensioning means have a movable tensioning element (22) acting upon the spooled yarn between the spool (10) and the sensing means (7, 9) transverse to the direction of yarn travel, the tensioning element being loaded with an adjustable force (26).

10. Yarn pull-off system according to claim 1, including a display device (41) for the quantity of spooled yarn pulled off per unit of time, the display device being supplied with the output signal of the sensing means (7, 9).

11. Yarn pull-off system according to claim 10, wherein the display device has a display for the tension of the spooled yarn supplied, this tension being measured by means of a yarn tension measuring device (69).

12. Yarn pull-off system according to claim 1, including a connection device (42) for signal lines, by way of which the output signal of at least one of:

the sensing means (7, 9);

a signal representative of the tension of the pulled-off spooled yarn can be interrogated.

13. Textile yarn removal and pull-off system to remove and pull off yarn (11) from a spool (10) and supply the yarn to a knitting feed of a knitting machine, as required by the knitting feed, having a stationary support means 1;

a spool support element (2) supported on the support means;

a flyer arm element (4) located to remove yarn tangentially from the spool, at least one of said elements (2, 4) being rotatable with respect to said support means (1);

a yarn guide means (16) secured to the flyer arm element to guide yarn removed from the spool and direct yarn to the knitting feed, a speed controllable electric drive motor (6, 6') drivingly coupled to the at least one of said elements (2, 4) which is rotatable;

a rotation reversal switch coupled to the drive motor;

a yarn pull-off speed sensing means (7, 9), secured to the flyer arm element having the yarn coupled thereto in slip-free manner and providing a yarn speed signal representative of the speed of yarn (1) being removed from the spool by said knitting feed at a speed determined by said knitting feed;

a control circuit means (33–38); and coupling means (30, 31) connected to said yarn pull-off speed sensing means for coupling the yarn speed signal to the control circuit means, said control circuit means (33–38) being coupled to the coupling means (30, 31) and receiving the yarn speed signal, said control circuit means being further connected to said motor, and controlling the speed of operation of said motor (6, 6') for controlling the output speed of the motor as a function of the speed of yarn sensed by the speed sensing means (7, 9) to control the motor speed as a function of the yarn speed signal, and wherein the yarn (11), the yarn pull-off—speed sensing means (7, 9), the drive motor (6) and the at least one rotatable element (2, 4) coupled to the motor form a closed control loop.

14. Yarn supply apparatus according to claim 13 wherein a yarn tension monitor (22, 60) is provided coupled with the drive motor (6), the tension monitor emitting a signal that reverses the drive motor (6) if the yarn tension drops below a predetermined threshold and the pulling off of spooled yarn is interrupted, under the influence of which signal a relative rotation between the flyer arm (4) and the spool (10) in the direction of return feeding of the yarn is generated until the predetermined spooled yarn tension threshold has been attained.

15. Yarn pull-off system according to claim 13 wherein the spool holder element (2) comprises a rotatably supported spool holder (2);

a drive source (6') is provided, driving said spool holder in the opposite direction from the flyer arm element (4); and drive source control means (205, 38') are provided, connected to the drive source, by means of which the speed ratio between the flyer arm (4) and the spool (10) can be maintained at a predetermined, optionally variable value.

16. Yarn pull-off system according to claim 15, wherein the drive source is formed as a stepping motor (6').

17. Yarn pull-off system according to claim 6, wherein the output signal is converted into a corresponding stepping motor control pulse train, and amplified.

18. Yarn pull-off system according to claim 1, wherein the knitting machine comprises a circular knitting machine.

19. Yarn pull-off system according to claim 18, including means (22, 23, 26) forming a yarn reserve, positioned in the yarn travel path between said spool (10) and the yarn pull-off speed sensing means (7, 9);

and a regulator (52) maintaining the size of the yarn reserved at a command value.

20. Yarn pull-off system according to claim 13, wherein a yarn tension monitor (22, 50) is provided, coupled with the drive motor (6), the tension monitor providing a signal which reserses the drive motor if the yarn tension drops below a predetermined threshold, said drive motor, under control of said signal, driving said spool holder (2) in a direction to rewind the yarn until the predetermined yarn tension threshold has been attained.

21. Yarn pull-off system according to claim 13, wherein the knitting machine comprises a circuit knitting machine.

* * * * *